US009467767B2

(12) United States Patent
Chen

(10) Patent No.: US 9,467,767 B2
(45) Date of Patent: Oct. 11, 2016

(54) MODULAR HEADPHONE SYSTEM

(71) Applicant: Wei-Hsiang Chen, New Taipei (TW)

(72) Inventor: Wei-Hsiang Chen, New Taipei (TW)

( * ) Notice: Subject to any disclaimer, the term of this patent is extended or adjusted under 35 U.S.C. 154(b) by 154 days.

(21) Appl. No.: 14/488,477

(22) Filed: Sep. 17, 2014

(65) Prior Publication Data

US 2016/0080853 A1 Mar. 17, 2016

(51) Int. Cl.
*H04R 1/10* (2006.01)

(52) U.S. Cl.
CPC ..... *H04R 1/1041* (2013.01)

(58) Field of Classification Search
CPC ..... H04R 1/1041
See application file for complete search history.

(56) References Cited

U.S. PATENT DOCUMENTS 3,306,991 A * 2/1967 Wood ..... A61F 11/14 381/322
6,466,681 B1 * 10/2002 Siska, Jr. ..... H04R 5/0335 381/370
2013/0208908 A1 * 8/2013 Theiler ..... G10K 11/178 381/71.6
2013/0329905 A1 * 12/2013 Awiszus ..... H04R 1/1058 381/74

FOREIGN PATENT DOCUMENTS

GB 1160431 * 8/1969

* cited by examiner

*Primary Examiner* — Ping Lee
(74) *Attorney, Agent, or Firm* — Rosenberg, Klein & Lee

(57) ABSTRACT

A modular headphone system includes a headband holding an earphone module at each end of two ends thereof, a circuit module formed of an active noise cancelling module, a Bluetooth module, high-frequency module and/or a multi-channel audio controller and detachably mounted in one earphone module, and a power module detachably mounted in the other earphone module. Each earphone module includes an earphone body pivotally connected to one end of the headband, a speaker holder mounted at the earphone body and electrically connected to the earphone body, a speaker mounted in the speaker holder and electrically connected to the speaker holder and an ear cushion covered on the speaker holder over the speaker.

8 Claims, 6 Drawing Sheets

MODULAR HEADPHONE SYSTEM

BACKGROUND OF THE INVENTION

1. Field of the Invention

The present invention relates to headphone technology and more particularly, to a modular headphone system, which allows selective installation of different designs of speakers and circuit modules in a detachable manner, providing the desired sound effects and quality, saving the costs and bringing convenience to the user.

2. Description of the Related Art

At present, with fast development of technologies, a variety of mobile electronic devices such as smart phones, audio and video players have been creased and are widely used by consumers. In order to get free from external interferences or not to interfere with others when listening to music or watching movies, people normally will wear a pair of small loudspeakers, namely, headphones or earphones that are held in place close to the ears. Commercial headphones or earphones include wired type and wireless type (see FIG. 5 and FIG. 6). A headphone system generally comprises a flexible headband, and two loudspeaker units respectively located at the two opposite ends of the flexible headband. A headphone system allows installation of wireless control circuit and other circuit means that enhances the sound effects. Thus, the audio output quality of a headphone system is better than a pair of earphones. Various different designs of headphone systems with active noise cancelling module, Bluetooth module, high-frequency module or multi-channel audio controller are commercially available. However, increasing the functions of a headphone system will relatively increase its cost. When buying a headphone system, most consumers will take economic considerations into account, and will buy a low priced wired headphone system at the initial stage, and will consider to buy a sophisticated headphone system when affordable. It costs a lot if one purchased multiple headphones having different functions. It is also inconvenience to keep and carry multiple headphones with different functions. Further conventional headphone systems do not allow the consumer to upgrade its specifications or changing its internal circuit module or other component parts. An improvement in this regard is desired.

SUMMARY OF THE INVENTION

The present invention has been accomplished under the circumstances in view. It is one object of the present invention to provide a modular headphone system, which allows selective installation of different designs of speakers and circuit modules in a detachable manner, providing the desired sound effects and quality, saving the costs and bringing convenience to the user.

It is another object of the present invention to provide a modular headphone system, which allows the circuit module and power module thereof to be respectively detachably connected to the earphone bodies of the respective earphone modules thereof by powerful magnets, hook joints, snaps or screw joints.

It is still is another object of the present invention to provide a modular headphone system, which has an audio jack provided at the earphone body of one earphone module thereof for the connection of an audio cable to electrically connect an external audio source unit to the modular headphone system for enabling the modular headphone system to be used as a wired headphone, and a cover plate detachably covered on the outer side of the earphone body of each earphone module thereof.

DETAILED DESCRIPTION OF THE PREFERRED EMBODIMENT

Figure 1:
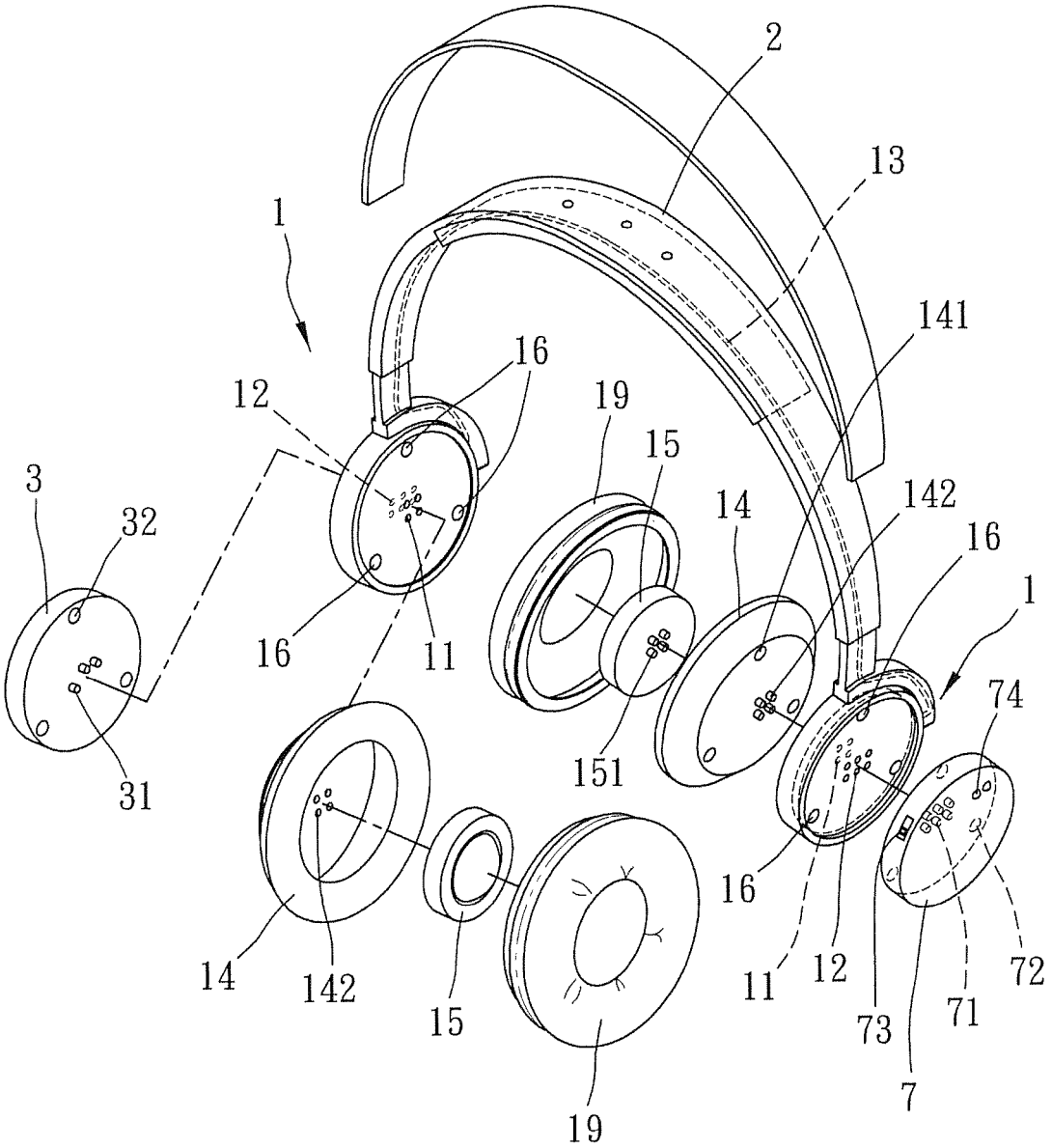
FIG. 1 is an exploded view of a modular headphone system in accordance with the present invention.
Figure 2:
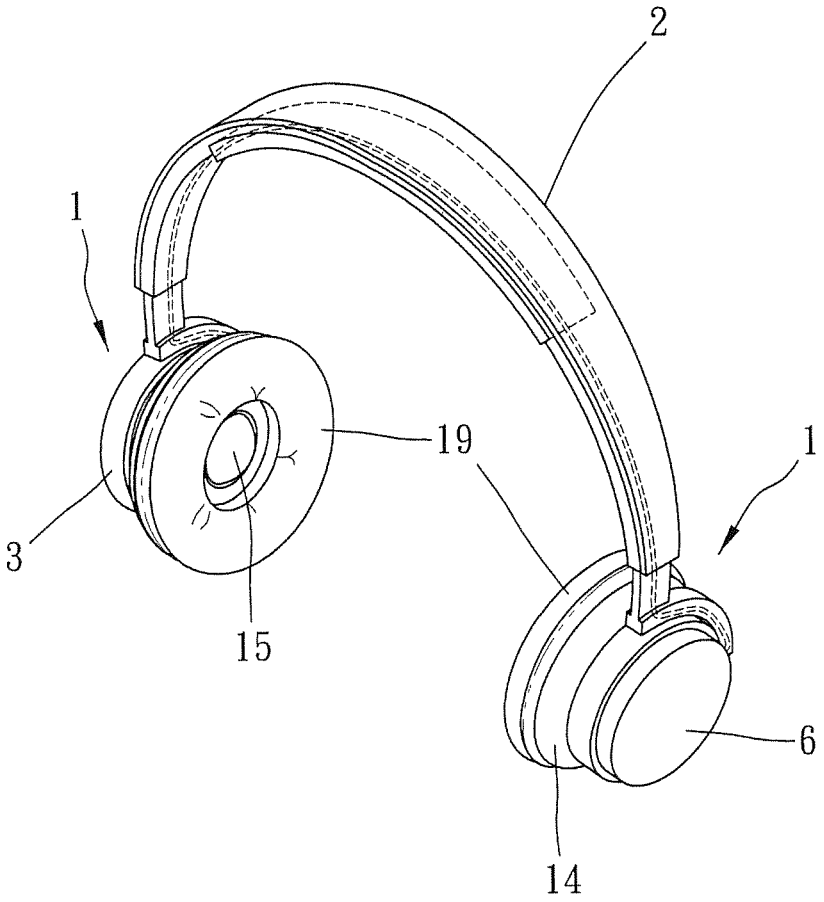
FIG. 2 is an elevational assembly view of the modular headphone system in accordance with the present invention.

Referring to FIGS. 1 and 2, a modular headphone system in accordance with the present invention is shown. The modular headphone system comprises a flexible headband (2), an earphone module pivotally connected to each of two opposite ends of the flexible headband (2), an electrical connection member (13) electrically connected between the two earphone modules, a circuit module (3) mounted in one earphone module, and a power module (7) mounted in the other earphone module.

Each the aforesaid earphone module comprises an earphone body (1) pivotally connected to one end of the flexible headband (2) and comprising first electric contacts (11) and second electric contacts (12) respectively located on opposing inner and outer sides thereof, a speaker holder (14) mounted at the earphone body (1) and comprising a plurality of electric contacts (142) that are respectively electrically kept in contact with the first electric contacts (11) of the earphone body (1), a speaker (15) mounted in the speaker holder (14) and comprising a plurality of electric contacts (151) that are respectively electrically connected to the electric contacts (142) of the speaker holder (14), an ear cushion (19) covered on the speaker holder (14) over the speaker (15). Further, the circuit module (3) is mounted at the outer side of the earphone body (1) of one earphone module, comprising a plurality of electric contacts (31) respectively electrically kept in contact with the second electric contacts (12) of the earphone body (1) of the associating earphone module for controlling the earphone modules to produce predetermined functions. The power module (7) is mounted at the outer side of the earphone body (1) of the other earphone module and adapted for providing the circuit module (3) and the earphone modules with the necessary working power supply, comprising a plurality of electric contacts (71) respectively electrically kept in contact with the second electric contacts (12) of the earphone body (1) of the associating earphone module.

The aforesaid circuit module (3) comprises an active noise cancelling module (4), a Bluetooth module (5), a high-frequency module (6) (for example, 2.4 GHz or 5 GHz) and/or a multi-channel audio controller where the electric contacts (41)(51)(61) of the circuit module (3) are respectively electrically connected to the second electric contacts (12) of the earphone body (1) of the associating earphone module.

Figure 3:
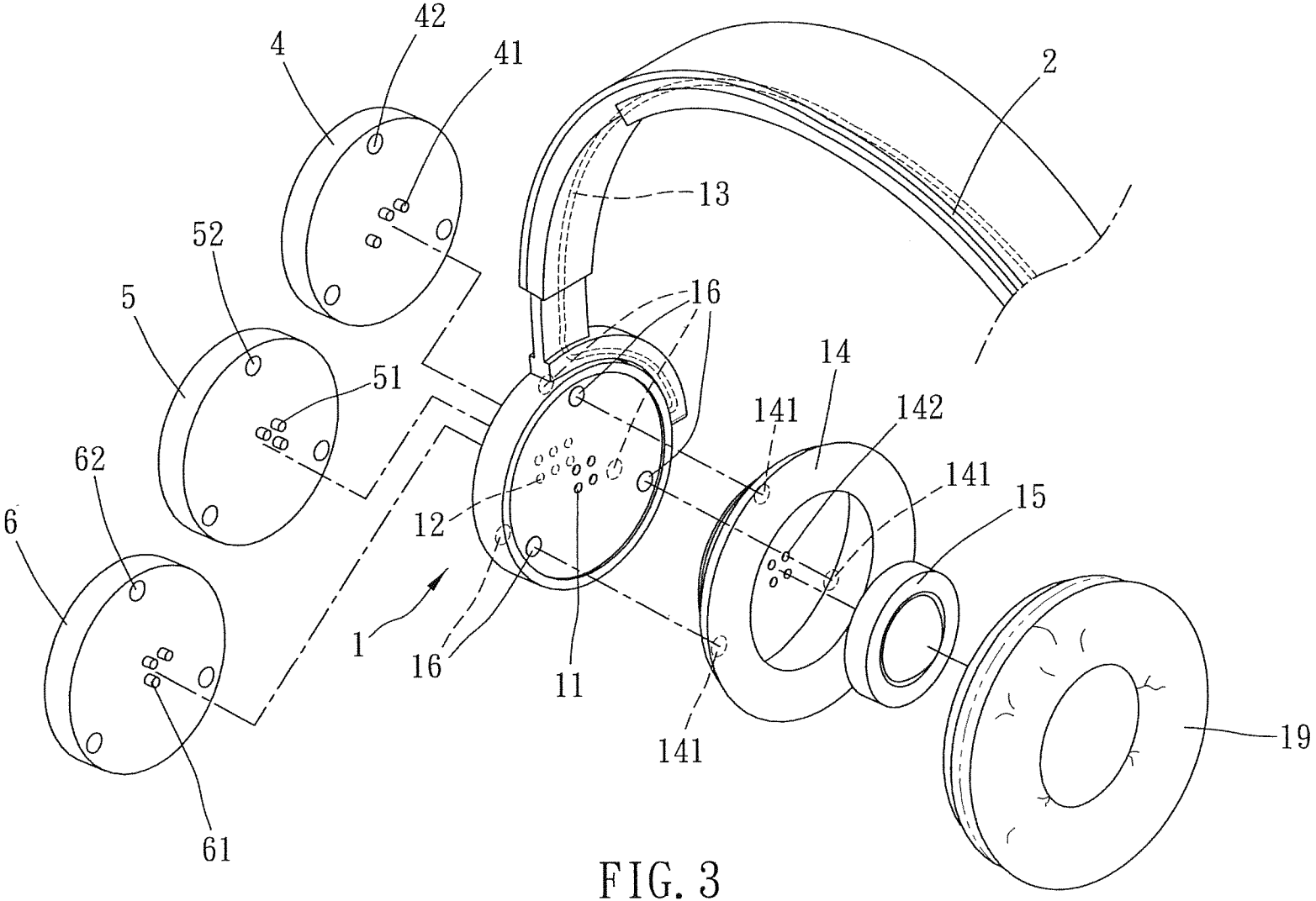
FIG. 3 is a schematic exploded view of a part of the present invention, illustrating different designs of circuit modules selectively used.

Further, the circuit module (3) and the power module (7) are respectively detachably connected to the earphone bodies (1) of the respective earphone modules (see FIG. 3) so that different designs of circuit modules (3) and power modules (7) having different configurations with different functions can be selectively used. Further, powerful magnets (141)(16)(32)(42)(52)(62)(72) can be used for connection in a detachable manner between the circuit module (3) and power module (7) and the earphone bodies (1) of the respective earphone modules. Hook joints, snaps, screw joints and other detachable fastening means may be selectively used as a substitute.

Further, a power switch (73) for power on/off control and power level indicator lights (74) for indicating different power levels can be installed in the power module (7) or the earphone body (1). Further, the power module (7) can be a rechargeable power module (7). Further, color indicator lights can be installed in the circuit module (3) for functional normality indication.

Figure 4:
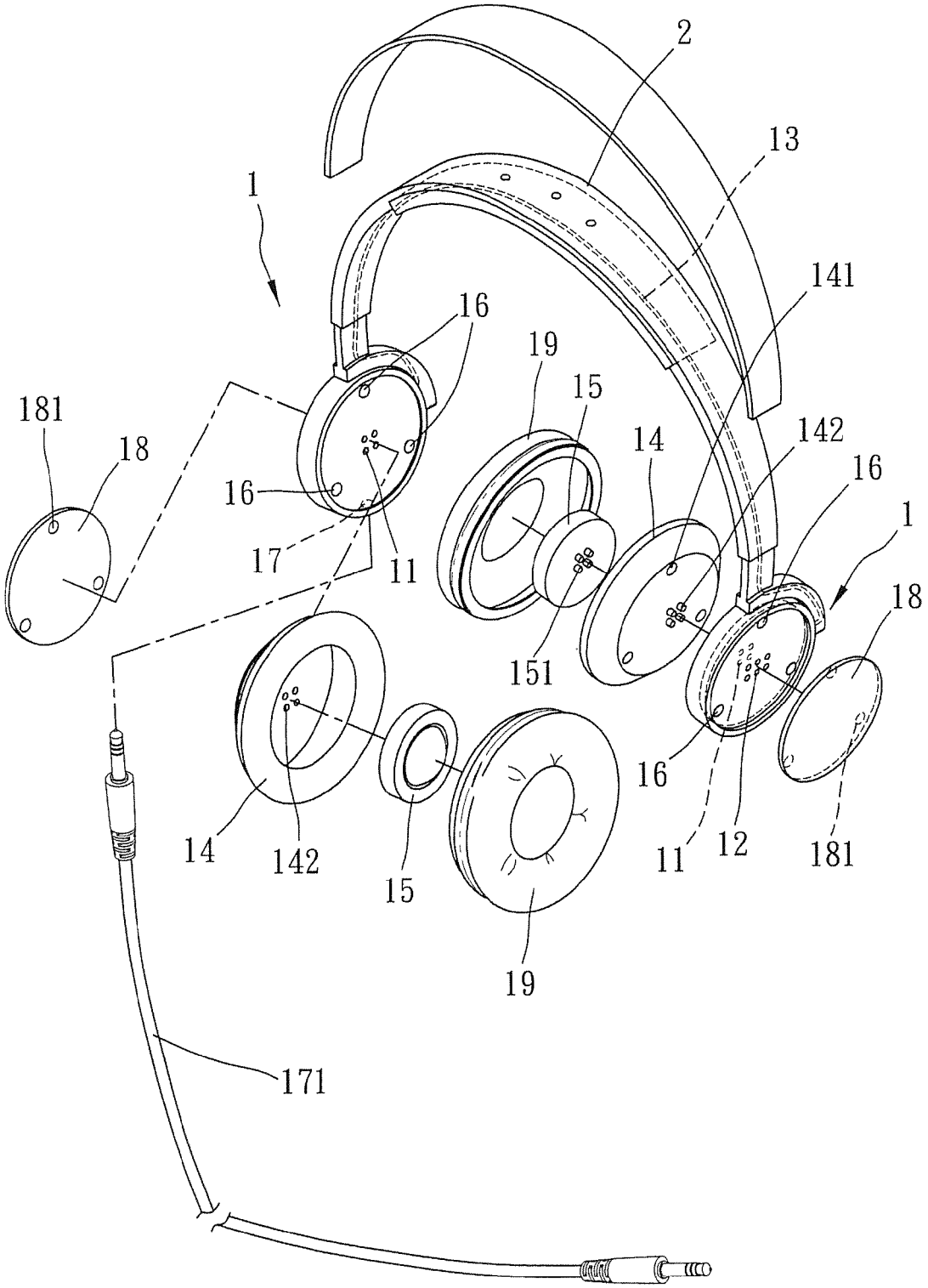
FIG. 4 is an exploded view of the present invention, illustrating the modular headphone system in the arrangement of a wired headphone.
Figure 5:
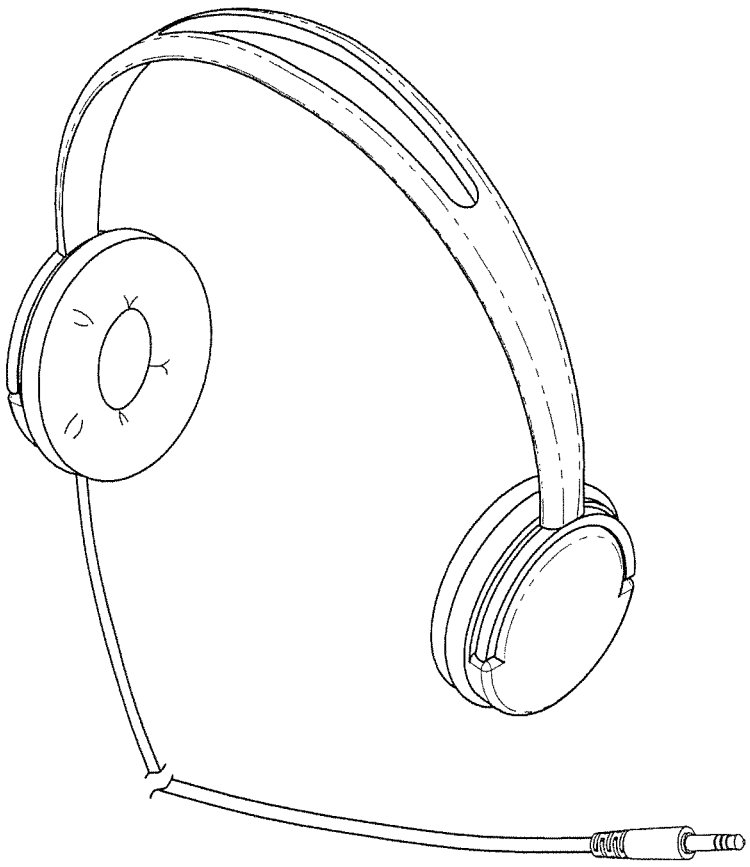
PRIOR ART FIG. 5
FIG. 5 is an elevational view of a wired headphone according to the prior art.
Figure 6:
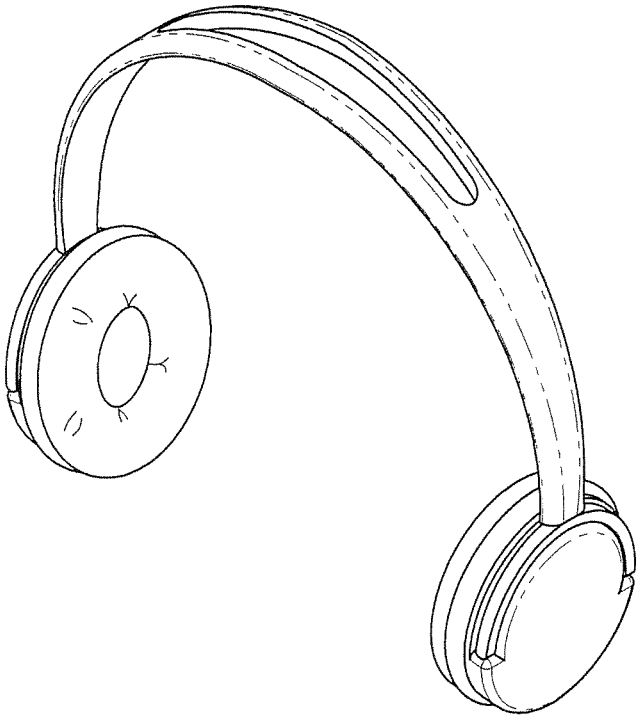
PRIOR ART FIG. 6
FIG. 6 is an elevational view of a wireless headphone according to the prior art.

Further, an audio jack (17) is provided at the earphone body (1) of one earphone module for the connection of an audio cable (171) to electrically connect an external audio source unit to the modular headphone system. Further, after removal of the power module (7) and the circuit module (3), cover plates (18) can be respectively covered on the outer sides of the earphone bodies (1) of the earphone modules and secured thereto by powerful magnets (181), enabling the modular headphone system to be used as a wired headphone (see FIG. 4).

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A modular headphone system comprising:

a flexible headband, an earphone module pivotally connected to each of two opposite ends of said flexible headband, an electrical connection member electrically connected between said two earphone modules, at least first and second alternative circuit modules of different functional type interchangeably mounted in one said earphone module, and a power module mounted in the other said earphone module, each said earphone module including an earphone body pivotally connected to one end of said flexible headband, said earphone body including a plurality of first electric contacts and a plurality of second electric contacts respectively located on opposing inner and outer sides thereof, a speaker holder mounted at the earphone body, said speaker holder comprising including a plurality of electric contacts respectively electrically kept in contact with the first electric contacts of said earphone body, a speaker mounted in the speaker holder, said speaker including a plurality of electric contacts respectively electrically connected to the electric contacts of said speaker holder and an ear cushion covered on said speaker holder over said speaker, said circuit module being mounted at the outer side of the earphone body of one said earphone module, said circuit module including a plurality of electric contacts respectively electrically kept in contact with the second electric contacts of the earphone body of the associating said earphone module for controlling the earphone modules to produce predetermined functions, said power module being mounted at the outer side of the earphone body of the other said earphone module and adapted for providing the circuit module and the earphone modules with the necessary working power supply, said power module including a plurality of electric contacts respectively electrically kept in contact with the second electric contacts of the earphone body of the associating said earphone module, each of said speaker holders, first and second circuit modules, and power module being detachably attached to respective ones of said earphone bodies to selectively configure the modular headphone system.

2. The modular headphone system as claimed in claim 1, wherein said circuit module comprises an active noise cancelling module, a Bluetooth module, a high-frequency module (for example, 2.4 GHz or 5 GHz) and/or a multi-channel audio controller.

3. The modular headphone system as claimed in claim 1, wherein said speaker holder, said circuit module and said power module are respectively detachably connected to the earphone bodies of the respective said earphone modules by powerful magnets, hook joints, snaps or screw joints.

4. The modular headphone system as claimed in claim 3, wherein said circuit module comprises an active noise cancelling module, a Bluetooth module, a high-frequency module (for example, 2.4 GHz or 5 GHz) and/or a multi-channel audio controller.

5. The modular headphone system as claimed in claim 2, wherein said circuit module, said speaker holder and said power module are respectively detachably connected to the earphone bodies of the respective said earphone modules.

6. The modular headphone system as claimed in claim 1, further comprising a power switch for power on/off control and power level indicator lights for indicating different power levels respectively installed in one of said power module and said earphone body, wherein said power module is rechargeable power module.

7. The modular headphone system as claimed in claim 1, further comprising a plurality of color indicator lights installed in said circuit module for functional normality indication.

8. The modular headphone system as claimed in claim 1, further comprising an audio jack provided at the earphone body of one said earphone module for the connection of an audio cable to electrically connect an external audio source unit to the modular headphone system, a cover plate detachably covered on the outer side of the earphone body of each said earphone module and secured thereto by powerful magnets.

* * * * *